United States Patent [19]

Kita et al.

[11] Patent Number: 4,813,340

[45] Date of Patent: Mar. 21, 1989

[54] ROTARY FLUID ENERGY TRANSLATING DEVICE

[75] Inventors: Yasuo Kita; Kazuyuki Kita, both of Kyoto, Japan

[73] Assignee: Shimadzu Corporation, Japan

[21] Appl. No.: 737,906

[22] Filed: May 24, 1985

Related U.S. Application Data

[63] Continuation of Ser. No. 436,972, Oct. 27, 1982, abandoned.

[30] Foreign Application Priority Data

Oct. 31, 1981 [JP] Japan ..... 56-175190

[51] Int. Cl.[4] ..... F01B 13/06

[52] U.S. Cl. ..... 91/488; 91/497; 91/498

[58] Field of Search ..... 91/472, 484, 485, 488, 91/491, 497, 498, 504, 505

[56] References Cited

U.S. PATENT DOCUMENTS

| | | | |
|---|---|---|---|
| 1,778,238 | 10/1930 | Wilsey | 91/488 |
| 2,245,570 | 6/1941 | Centervall | 91/472 |
| 2,747,515 | 5/1956 | Montelius | 91/472 |
| 3,094,077 | 6/1963 | Cadiou | 91/472 |
| 3,194,171 | 7/1965 | Ohligs | 91/472 X |
| 3,498,229 | 3/1970 | Prelesnik | 417/269 |
| 3,650,180 | 3/1972 | Gantschnigg et al. | 91/488 |
| 3,744,380 | 7/1973 | Steiger | 91/488 X |
| 3,750,533 | 8/1973 | Thoma | 91/498 |
| 3,943,826 | 3/1976 | Kita | 91/488 |
| 4,137,826 | 2/1979 | Kita | 91/497 |

FOREIGN PATENT DOCUMENTS

| | | | |
|---|---|---|---|
| 2416772 | 10/1975 | Fed. Rep. of Germany | 91/488 |

*Primary Examiner*—William L. Freeh
*Assistant Examiner*—Paul F. Neils
*Attorney, Agent, or Firm*—Fidelman & Wolffe

[57] ABSTRACT

A rotary fluid energy translating device which comprises a casing and a couple ring rotatably supported in the casing. Static fluid pressure is applied to the couple ring at circumferentially spaced points and from both the outer and the inner side of the ring so that a couple of forces is produced in the couple ring while providing balanced static pressure on the ring at each of the circumferentially spaced points thereby to rotate the couple ring, which can be connected to a mechanical element outside the casing. By positively rotating the couple ring by means of an external drive, it is possible to operate the device as a fluid pump.

8 Claims, 6 Drawing Sheets

ROTARY FLUID ENERGY TRANSLATING DEVICE

This application is a continuation, of application Ser. No. 436,972, filed 10/27/82 now abandoned.

BACKGROUND OF THE INVENTION

This invention relates to a rotary fluid energy translating device suitable for use as a fluid pump or a fluid motor of the static pressure type.

Conventional fluid pumps or motors of this type are necessarily provided with a mechanism including a cam and/or linkage for converting the rotational force of an input shaft into the linear force of a piston, a plunger or the like linearly moving element, or inversely the linear force of such an element into the rotational force of an output shaft. Since the component parts or elements of such mechanisms usually move relative to each other under a considerable amount of mutual contact force, it is essential to provide either a sliding bearing which utilizes, for example, the wedge effect of a film of lubricating oil due to its oiliness or viscosity, or an anti-friction bearing which utilizes the rolling action of balls or rollers.

In the sliding bearing, it is necessary to use as the working fluid an oil which has a proper viscosity. With water or any other fluid having a viscosity similar to that of water, it is difficult to run the machine smoothly with resulting shortening of the life of the machine. Therefore, the kind of working fluid that can be used in the sliding bearing is limited. This is a great disadvantage.

If an anti-friction bearing is used in the machine, the life of the whole machine depends on that of the bearing, so that it is difficult to increase the durability of the machine. Moreover, the anti-friction bearing is comparatively large in size, so that it is difficult to make the machine which includes such anti-friction bearings compact in size and light in weight.

Accordingly, the primary object of the invention is to provide a rotary fluid energy translating device which utilizes static fluid pressure bearing for conversion of a linear to a rotational force or inversely a rotational to a linear force without using any mechanical energy translating means, thereby to eliminate the above-mentioned and other disadvantages of the conventional devices.

The invention will be described in detail with reference to the accompanying drawings.

SUMMARY OF THE INVENTION

Figure 1:
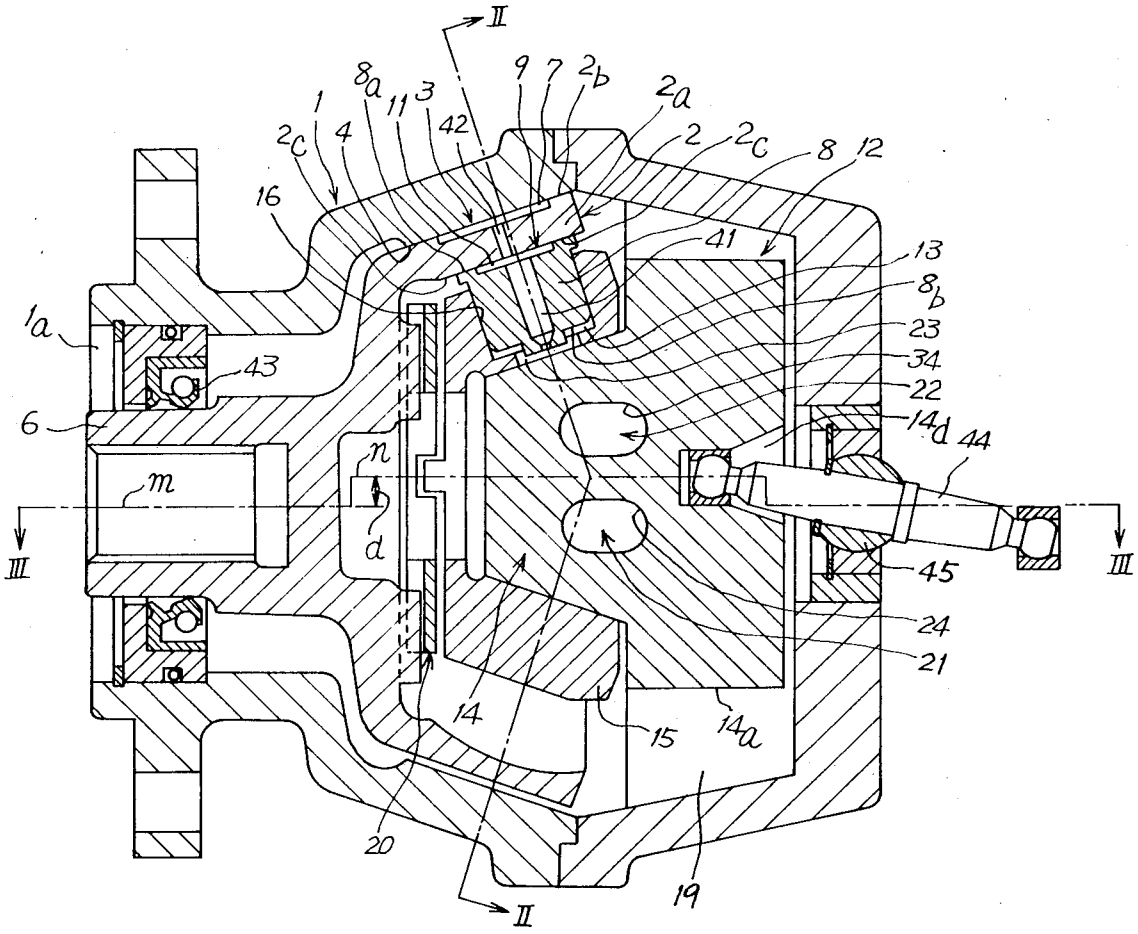
FIG. 1 is a vertical sectional view of one embodiment of the invention.

The device of this invention comprises a first generally annular member having an inner circumferential surface and a second generally annular member disposed in the first generally annular member. The first generally annular member preferably comprises a casing formed in two cup-shaped members put together to define an enclosed chamber and provided with a pair of ports through which fluid is introduced into and discharged from the chamber. The second generally annular member comprises a couple ring rotatably supported in the casing and formed with a shaft for drive connection to an external mechanical element.

A plurality of first static pressure bearings are interposed between the inner circumferential surface of the casing and the outer circumferential surface of the couple ring at circumferentially spaced intervals.

A structure for supporting pistons is disposed inside the couple ring and includes a cylinder barrel associated with the couple ring for simultaneous rotation therewith about a parallel axis. The cylinder barrel is provided with a plurality of radially arranged cylinder bores, in each of which a piston is partially and slidably inserted for reciprocation therein upon rotation of the couple ring relative to the casing so as to vary the capacity of the cylinder bores. The pistons have their outer end faces in contact with the inner circumferential surface of the couple ring, with a plurality of second static pressure bearings interposed therebetween at circumferentially spaced positions corresponding to the first static pressure bearings on the outer circumferential surface of the couple ring.

Each of the first static pressure bearings is associated with the corresponding one of the second static pressure bearings so that a static pressure prevails in the associated bearings.

The piston supporting structure is provided with a pair of fluid passages, one of which communicates one of the ports in the casing with those of the cylinder bores the capacity of which is increasing while the other of the passages communicates the other of the ports with those of the cylinder bores the capacity of which is decreasing.

When the device is to be operated as a fluid motor, high pressure fluid is introduced through one of the fluid passages into those of the cylinder bores whose capacity is to increase and thence into the corresponding first and second static pressure bearings, so that the static pressures in the first and second bearings produce a couple of forces in the couple ring at circumferentially spaced apart points thereof thereby to rotate the couple ring, while the fluid in the cylinder bores the capacity of which is decreasing is discharged from the casing through the other passage. The rotation of the couple ring can be taken out through the shaft.

When the device is to be operated as a pump, the couple ring is rotated by externally rotating the shaft.

DESCRIPTION OF THE PREFERRED EMBODIMENT

Referring now to FIGS. 1 through 4, there is shown a casing 1 consisting of two cup-shaped members put together to define an enclosed chamber, in which a couple ring 2 is disposed and rotatably supported by a group of first static pressure bearings 3.

One of the cup-shaped members of the casing 1 is provided at one axial end thereof with an opening 1*a* and has its inner diameter decreasing toward the opening 1*a* so that the inner circumferential surface 4 of the member is of a truncated conical shape.

The couple ring 2 is composed of a cup-shaped member having a circumferential wall 2*a* generally conforming to the conical inner surface of the cup-shaped member of the casing 1. On the outer surface of the wall 2*a* of the couple ring 2 there are formed at circumferentially spaced equal intervals a plurality of conical surface sections 2*b* in close contact with the conical inner surface of the casing 1.

A rotatable shaft 6 is formed as an integral part of the couple ring 2 for simultaneous rotation therewith about the same axis. The outer end of the shaft 6 is accessible from outside through the opening 1*a* of the casing 1 for mechanical connection to a suitable member outside the casing 1 as will be described later.

Each static pressure bearing 3 comprises a pressure pocket 7 formed in each of the conical surface sections 2*b* of the couple ring 2 and filled with pressure fluid introduced thereinto in a manner to be described later. In the illustrated embodiment there are seven first static pressure bearings 3 thus formed at equal angular intervals on the outer circumferential surface of the couple ring 2.

On the inner circumferential surface of the couple ring 2 there are formed a plurality, say, seven flat surface sections 2*c* each at a position corresponding to one of the static pressure bearings 3 on the outer circumferential surface of the couple ring 2.

Inside the couple ring 2 there are radially arranged a plurality, say, seven pistons 8, with a second group of static pressure bearings 9 interposed between the pistons 8 and the inner surface of the torque ring 2. In particular, each piston 8 has an outer flat end face 8*a* in contact with a corresponding one of the seven flat inner surface sections 2*c* of the couple ring 2, and the outer flat end face of the piston 8 is formed with a recessed pressure pocket 11, into which fluid under pressure is introduced to provide the second static pressure bearing 9.

Inside the couple ring 2, there is provided a piston supporting structure 12 which comprises a pintle 14 formed with a slide block 14*a* and having an axis n parallel with the axis m of the machine casing 1, and a cylinder barrel 15 rotatably carried by the pintle 14 and disposed inside the couple ring 2. The cylinder barrel 15 comprises a generally cup-shaped member having a circumferential wall tapering toward the rotatable shaft 6 of the couple ring 2.

A plurality of cylinder bores 16 are formed in the tapering wall of the cylinder barrel 15 in such a manner that the cylinder bores are radially directed and arranged circumferentially of the cylinder barrel at equal intervals, with the axes of the cylinder bores extending substantially perpendicularly to the tapering outer circumferential surface of the frustoconical portion of the pintle 14.

The pistons 8 are slidably fitted in the cylinder bores 16 so that they are supported radially by the cylinder barrel 15, with a space 13 of variable capacity being left in each cylinder bore radially inwardly of the inner end face 8*b* of each piston. The outer end face of each piston projects from the cylinder bore so as to be in close contact with the flat inner surface section 2*c* of the couple ring 2.

An Oldham's coupling 20 provides a drive connection between the cylinder barrel 15 and the couple ring 2 so that the cylinder barrel 15 and the couple ring 2 are rotated at the same angular speed.

The pintle 14 is of a frustoconical shape and its outer conical surface has substantially the same inclination as the circumferential wall 2*a* of the couple ring 2, and the pistons 8 are supported so as to be able to reciprocate in the direction perpendicular to the wall 2*a* of the couple ring 2.

Figure 3:
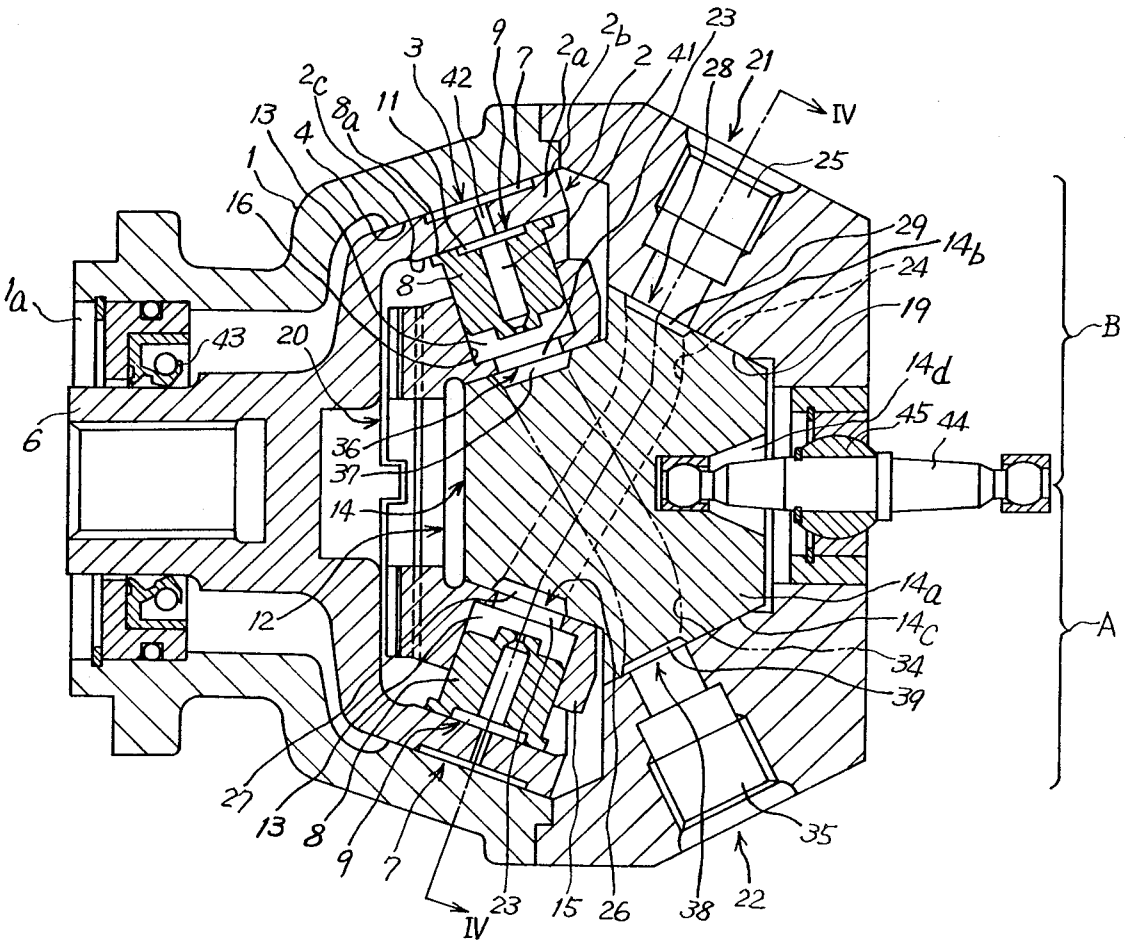
FIG. 3 is a sectional view taken on line III—III in both FIGS. 1 and 2.

The slide block 14*a* is of a trapezoidal shape in transverse section as shown in FIG. 3, and slidably fitted in a groove 19 formed in the casing 1. The casing 1 is provided at one end wall thereof with an operating lever 44 which is swingable by means of a ball joint 45 and has its inner end engaged in a pit 14*d* formed in the slide block 14*a* and its outer end projecting outside the casing 1 for manual operation or mechanical connection to a suitable controller.

By operating the lever 44 it is possible to move the pintle 14 in a direction perpendicular to the axis m of the casing 1 thereby to adjust the eccentricity of the axis n of the pintle 14 and hence the cylinder barrel 15 with respect to the axis m of the casing to a desired distance d including a zero distance, that is, coincidence of the two axes.

Suppose that the interior space of the casing 1 is divided into two area A and B by an imaginary straight line P extending in the direction of movement of the pintle 14. The spaces 13 in the cylinder bores 16 below the pistons 8 in the area A communicate with a first fluid passage system 21 while the spaces 13 in the cylinder bores below the pistons in the area B communicate with a second fluid passage system 22.

The first fluid passage system 21 comprises an inner port 23 which makes the space 13 below the piston 8 in each cylinder bore 16 open to the inside of the cylinder barrel 15, and a bore 24 extending through the pintle 14 and having at one end an opening in the outer conical surface of the pintle 14 in the area A and at the other end an opening in the inclined surface 14*b* of the slide block 14*a* in the area B. The first fluid passage system 21 further comprises an outer port 25 formed in the wall of the casing 1 in communication with the through bore 24 in the pintle 14.

A pressure pocket 27 communicating with one end of the through bore 24 is recessed in the conical surface of the pintle 14 so as to provide a third static pressure bearing 26 between the conical surface of the pintle 14 and the inner surface of the cylinder barrel 15, while a pressure pocket 29 communicating with the opposite end of the through bore 24 is recessed in the inclined surface 14*b* of the slide block 14*a* so as to provide a fourth static pressure bearing 28 between the inclined surface 14*b* and the inner surface of the casing 1.

The pressure pocket 27 extends circumferentially of the pintle and has such a length as to be able to communicate all the spaces 13 in the cylinder bores that are positioned in the first area A with the through bore 24 in the pintle 14. The pressure pocket 29 extends in the direction of sliding movement of the slide block 14*a* and has such a length as to be able to keep communication between the opposite end of the through bore 24 and the outer port 25 in the wall of the casing 1 while the slide block slides in the groove 19.

Similarly, the second fluid passage system 22 comprises the above-mentioned inner ports 23, and a bore 34 extending through the pintle 14 and having at one end an opening in the outer conical surface of the pintle 14 in the area B and at the other end an opening in the opposite inclined surface 14*c* of the slide block 14*a* in the area A. The second fluid passage system 22 further comprises an outer port 35 formed in the opposite wall of the casing 1 in communication with the through bore 34 in the pintle 14.

A pressure pocket 37 communicating with one end of the through bore 34 is recessed in the conical surface of the pintle 14 so as to provide another third static pressure bearing 36 between the conical surface of the pintle 14 and the inner surface of the cylinder barrel 15, while a pressure pocket 39 communicating with the opposite end of the through bore 34 is recessed in the opposite inclined surface 14c of the slide block **14*a* so as to provide another fourth static pressure bearing 38 between the inclined surface 14*c* and the inner surface of the casing 1**.

The pressure pockets 37 and 39 are equivalent to the previously mentioned pressure pockets 27 and 29, respectively, in structure and function.

Each piston 8 is provided with an axial through bore 41, through which the fluid pressure in the space 13 of each cylinder bore 16 is transmitted to the second static pressure bearing 9 in the corresponding pressure pocket 11. The couple ring 2 is provided with a plurality, say, seven bores 42, through which the fluid pressure in the pressure pocket 11 of each of the pistons 8 is transmitted to the first static pressure bearing 3 in the corresponding one of the pressure pockets 7 on the outer conical surface sections of the couple ring.

The areas of the first and second static pressure bearings 3 and 9 and the directions of the static pressures thereof are so selected that the force Fa which the static pressure of the fluid in each first static pressure bearing 3 exerts on the couple ring 2 and the force Fb which the static pressure of the fluid in the corresponding second static pressure bearing 9 exerts on the couple ring are equal in magnitude and opposite in direction.

Figure 5:
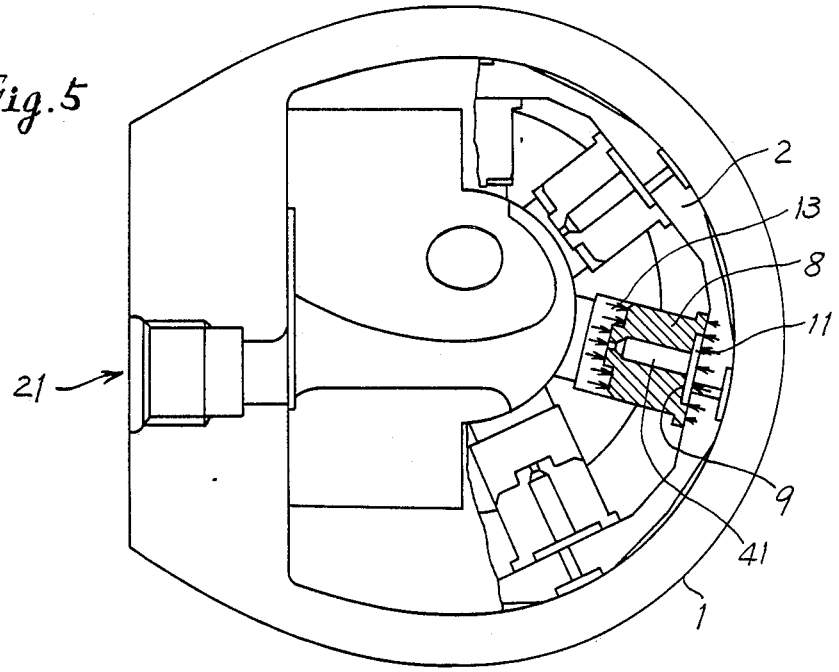
FIGS. 5 through 8 are views for explanation of the operation of the device shown in FIGS. 1 through 4.

As shown in FIG. 5, the area of each second static pressure bearing 9 is such that the force which the static pressure of the fluid in the bearing 9 exerts on the piston 8 and the force which the static pressure of the fluid in the space 13 exerts on the piston 8 offset each other.

Figure 6:
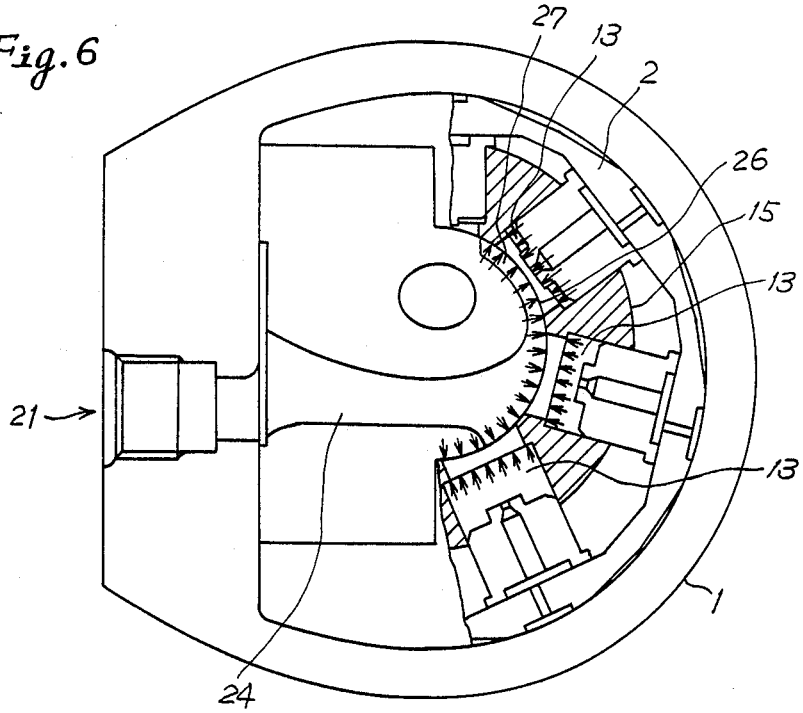

As shown in FIG. 6, the area of the third static pressure bearing 26, 26 is such that the force which the static pressure of the fluid in the bearing 26, 36 exerts on the cylinder barrel 15 is offset by the force which the static pressure of the fluid in the spaces 13 of the cylinder bores 16 in the corresponding area A, B exerts on the cylinder barrel 15.

Figure 7:
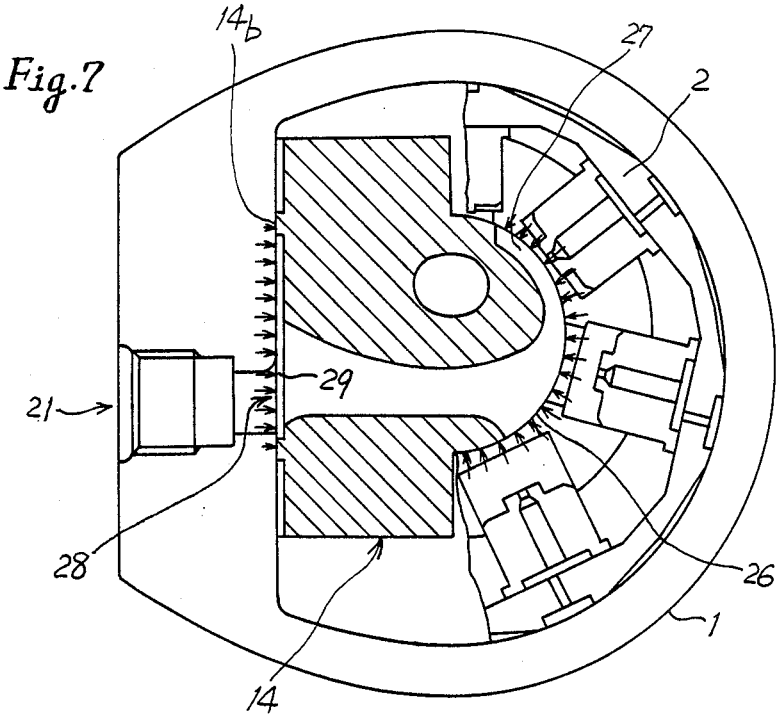
Figure 8:
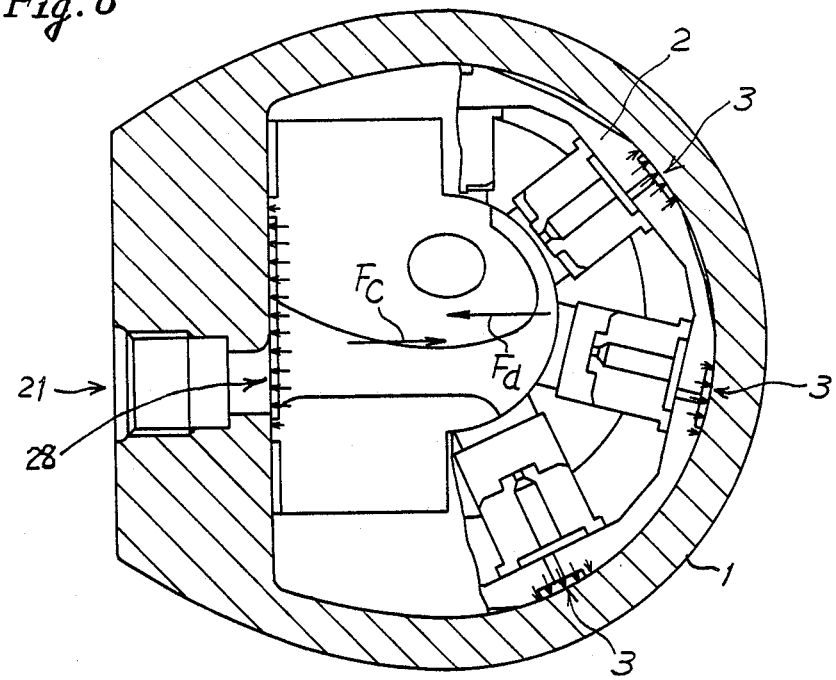

As shown in FIGS. 7 and 8, The area of the fourth static pressure bearing 28, 38 and the angle of inclination of the inclined surface **14*b*, 14*c* of the pintle 14 on which the bearing is provided are such that the force which the static pressure of the fluid in the fourth static pressure bearing 28, 38 exerts on the pintle 14 is offset by the force which the static pressure of the fluid in the third static pressure bearing 26, 36 in the area A, B opposite to the inclined surface 14*b*, 14*c* exerts on the pintle 14**.

In operation, a high pressure fluid is introduced into the spaces 13 in, say, the area A through the first fluid passage system 21.

The lever 44 is then operated to displace the common axis n of the pintle 14 and the cylinder barrel 15 a desired eccentric distance d from the axis m of the casing 1, whereupon the line of action of each of the forces Fa exerted on the couple ring 2 by the fluid in the first static pressure bearings 3 in the area A is displaced from the line of action of each of the forces Fb exerted on the couple ring 2 by the fluid in the corresponding second static pressure bearings 9, so that each pair of forces Fa and Fb constitute a couple of forces, that is, two parallel forces equal in magnitude and opposite in direction.

Figure 4:
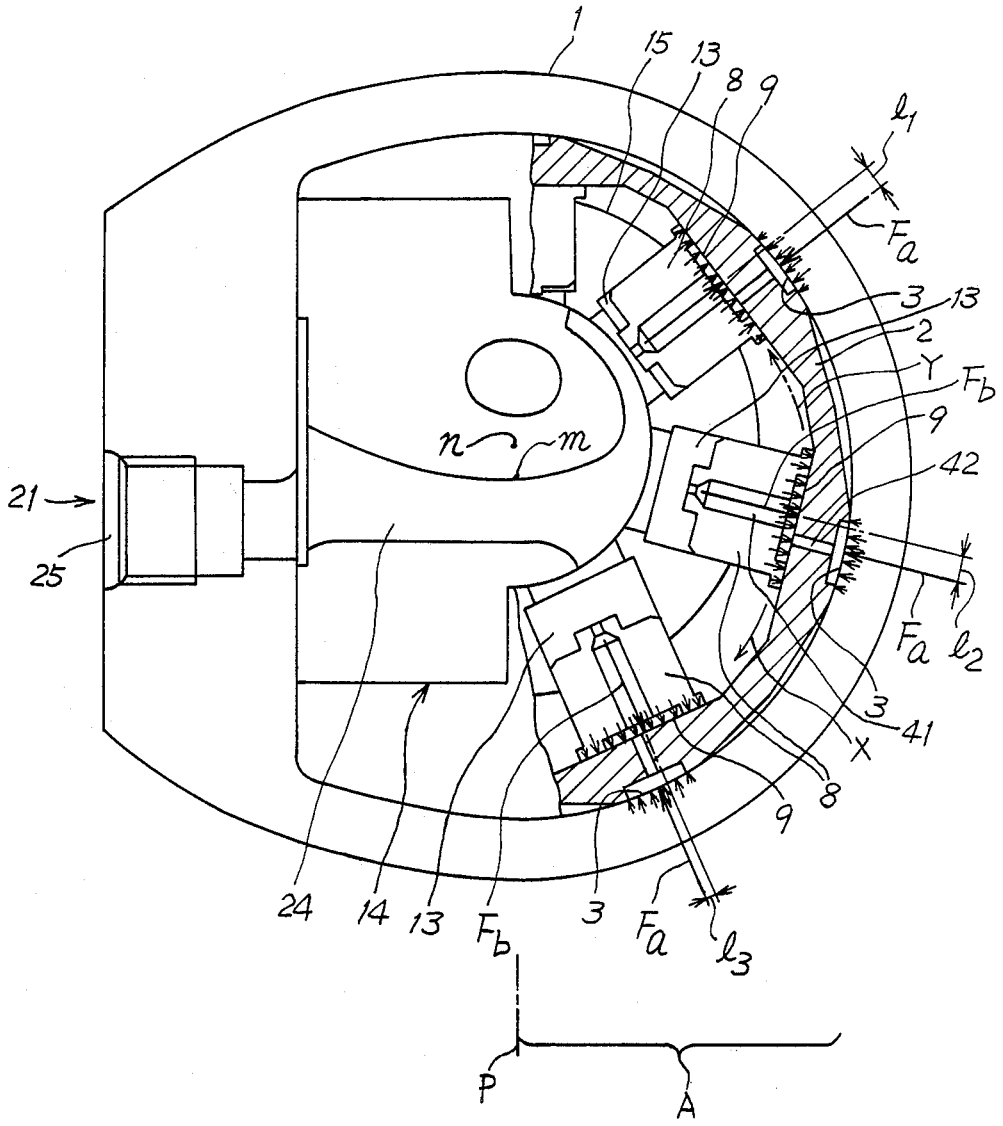
FIG. 4 is a sectional view taken on line IV—IV in FIG. 3.

In the illustrated embodiment, as shown in FIG. 4 three couples of forces Fa and Fb are produced at three points on the couple ring 2 and cooperate to rotate the couple ring clockwise as indicated by an arrow X. If each of the couple of forces Fa and Fb has a magnitude of F and the distances between the lines of action of the forces Fa and Fb are $l_1$, $l_2$ and $l_3$, respectively, the moment M acting on the torque ring 2 equals to F $(l_1+l_2+l_3)$. This moment M causes the couple ring 2 to rotate about the axis m relative to the casing 1. As the couple ring 2 rotates, the capacity of each space 13 gradually increases in the region A and decreases in the region B, so that high pressure fluid flows through the first fluid passage system 21 into the spaces 13 moving in the region A while the fluid in the spaces 13 moving in the region B is discharged from the casing 1 through the fluid passage system 22.

Under the condition, if the lever 44 is operated to restore the pintle 14 to the neutral position where the two axes m and n coincide, the lengths $l_1$, $l_2$ and $l_3$ between the lines of action of the forces Fa and Fb become all zero, thereby to render the moment M and consequently the output of the device zero.

Figure 2:
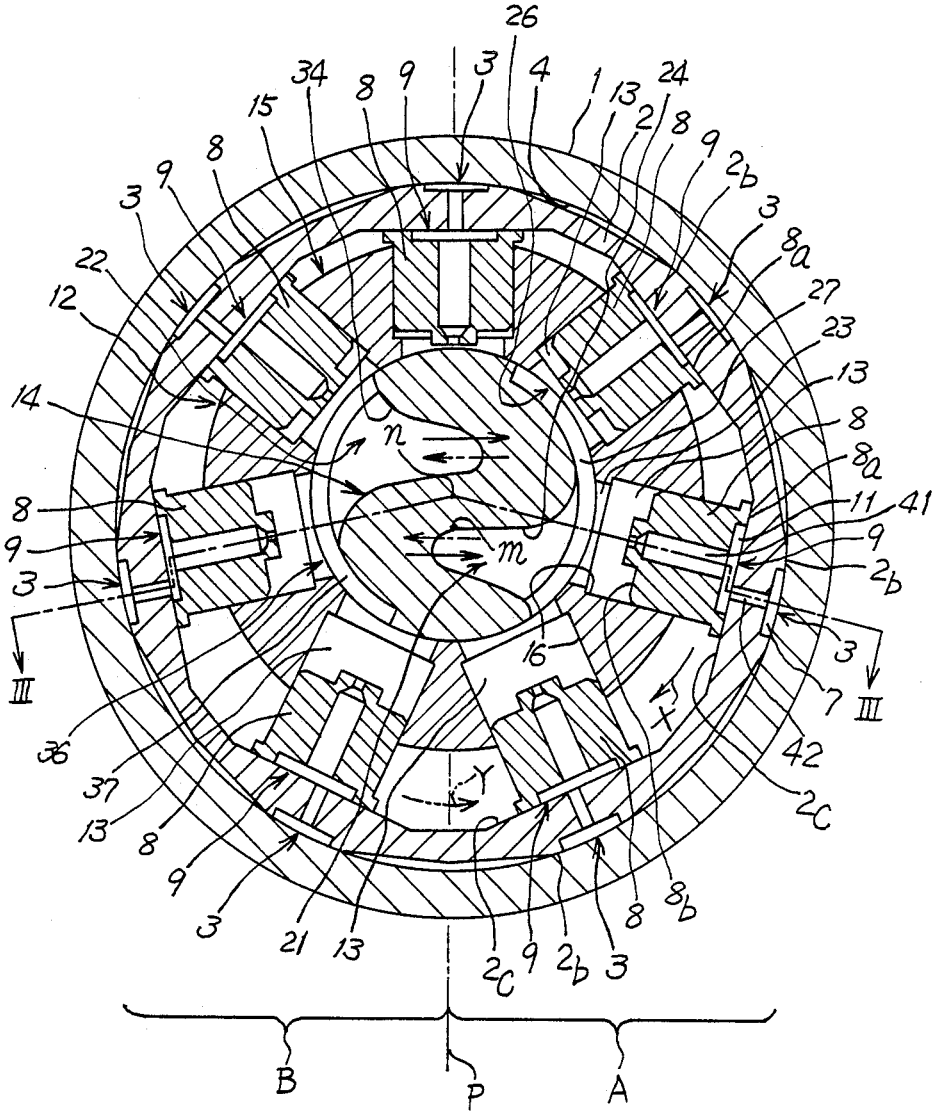
FIG. 2 is a transverse sectional view taken on line II—II in FIG. 1.

If the pintle 14 is displaced beyond the neutral position to the other side of the axis m of the casing 1, the distances $l_1$, $l_2$ and $l_3$ become negative so that the ring 2 is rotated in the opposite direction, that is, counterclockwise as indicated by an arrow Y in FIG. 2.

If the device is to be operated as a pump, the ring 2 is positively driven by a torque externally given to the ring 2 through the shaft 6 to rotate in, say, the direction of the arrow Y, whereupon couples of forces Fa and Fb are generated in the couple ring 2 by the fluid in the spaces 13 in the region A so as to balance the input driving torque given to the couple ring 2. From outside the casing 1 fluid is introduced through the second fluid passage system 22 into the spaces 13 moving in the region B, and at the same time the fluid in the spaces 13 in the region A is pressurized and discharged from the casing through the first fluid passage system 21.

If the pintle 14 is brought to the neutral position where the axes m and n coincide, no fluid is discharged from the casing while the couple ring 2 is kept rotating under balanced static pressure.

If the pintle 14 is brought to an eccentric position at the opposite side of the neutral position, the couples of forces Fa and Fb which balance the input torque are produced in the region B, so that high pressure fluid is discharged from the casing 1 through the second fluid passage system 22.

As described above, the rotary fluid energy translating device of the invention can be used as a pump or a motor. In either case, couples of forces Fa and Fb are produced in the couple ring 2 by only the static pressure of the fluid introduced into the first and second static pressure bearings 3 and 9, and the couples of forces balance the input or the output couple acting on the couple ring 2.

With the machine of the invention it is possible to convert the static pressure of fluid directly into only the rotational force of the couple ring 2, or the rotational force of the ring 2 directly into fluid pressure without the necessity of using any mechanism for mechanically converting a rotational into a linear force or a linear into a rotational force. Therefore, it is easy to make the machine of such a design that no strong pressing and/or twisting forces act on the component parts, thereby to completely avoid use of those bearings which rely on the wedge effect of an oil film due to the oiliness and viscosity of lubricating oil and/or those bearings which rely on the rolling action of balls, rollers or the like. In other words, it is possible to use static pressure bearings between component parts in sliding contact with each other, with water or the like liquid having a viscosity similar to that of water being used as the operative fluid without any trouble or inconvenience.

With static pressure bearings substituted for rolling bearings, the device of the invention can have a longer life and be made light in weight.

The piston supporting structure is not limited to that illustrated and described above. The illustrated structure, however, has the advantage that a simple mechanism suffices to change the relative positions of the first and second static pressure bearings to produce a couple of forces and simultaneously change the capacity of the space for the working fluid.

With the illustrated arrangement that the eccentricity of the pintle relative to the couple ring is adjustable, the device can advantageously be used as a motor or pump of the variable capacity type. The invention, however, is not limited to this arrangement.

The structure of the fluid passages is not limited to that illustrated, which has the advantage that static bearings can be easily provided between component parts.

In the illustrated embodiment, static pressure bearings are provided between principal component parts, and by properly selecting the position, size and/or orientation of the static pressure bearings it is possible to keep static pressures on all major component parts well-balanced. This invention, however, is not limited to this embodiment, but various modifications and structural changes may be made. For example, the circumferential surface of the pintle may be made cylindrical, so that the pistons reciprocate in truly radial direction. With the illustrated arrangement, however, all major component parts serve only as seals of the pressure balance type and need not have a very high surface strength and a very high shear strength, so that ceramic materials, engineering plastics, or the like new materials can advantageously be used for the component parts without any trouble.

In the illustrated embodiment, the resulant force Fc of the forces that the static pressure of the first static pressure bearings 3 exert on the casing 1 and the force Fd that the static pressure of the fourth static pressure bearing 28 exerts on the casing 1 form a couple of forces as shown in FIG. 8. This means that a reaction force in a rotational direction is produced by static pressure alone so as to act on the casing.

The static pressure bearings are not limited to the illustrated structures. They may have a plurality of pressure pockets. In the illustrated embodiment, seven pistons are provided. The number of pistons is not limited to seven. The working fluid is not limited to oil, water and other liquids, but gas such as air may also be used.

What we claim is:

1. A rotary fluid energy translating device comprising:

a first generally annular member having an inner circumferential surface;

a second generally annular member disposed in said first generally annular member so as to be rotatable about a first axis relative to said first generally annular member and having on its inner circumferential surface a plurality of flat surface sections;

a plurality of first static fluid pressure bearings formed in the outer circumferential surface of said second generally annular member at circumferentially spaced positions corresponding to said flat surface sections;

a piston supporting structure disposed inside said second generally annular member and provided with a plurality of cylinder bores radially arranged at circumferentially spaced intervals;

a plurality of pistons partially and slideably inserted in said cylinder bores for reciprocation therein during relative rotation of said first and second generally annular members, so as to vary the capacity of said cylinder bores, said pistons having outer end faces, each in slidable contact with a corresponding one of said flat surface sections of said second generally annular member;

a plurality of second static fluid pressure bearings formed in said outer end faces of said pistons said second static fluid pressure bearings being equal in number to said first bearings with one-to-one communication between corresponding first and second bearings in order to provide balanced static pressures on said second annular member;

means for defining a pair of fluid passages one of which communicates with said cylinder bores of which the capacity is increasing , while the other of said passages communicates with said cylinder bores of which the capacity is decreasing; and fluid passage means for introducing fluid in said cylinder bores into said first and second static fluid pressure bearings whereby the static pressure of the fluid in each of said first static pressure bearings and the static pressure of the fluid in each corresponding one of said second static pressure bearings define a force couple acting upon said second generally annular member to produce a moment of rotation to said second generally annular member.

2. The device of claim 1, wherein said first generally annular member comprises a casing and said second generally annular member comprises a cup-shaped couple ring provided at one end thereof with a shaft supported by said casing rotatably about said first axis.

3. The device of claim 1 or 2, wherein said piston supporting structure comprises a pintle having a second axis parallel with said first axis and provided with an integrally formed block supported by said first generally annular member, and a cylinder barrel carried by said pintle so as to be rotatable about said second axis, said cylinder bores being formed in said cylinder barrel.

4. The device of claim 3, wherein said block of said pintle is slidably supported by said first generally annular member, and further including means for displacing said block so as to adjust the eccentricity of said pintle relative to said second generally annular member.

5. The device of claim 4, wherein each of said fluid passages comprises a through bore formed in said pintle and having one end open in the outer surface of said pintle for selective communication with said cylinder bores and the opposite end open in the outer surface of said integrally formed block of said pintle for continuous communication with a port formed in said first annular member.

6. The device of claim 3, wherein each of said fluid passages comprises a through bore formed in said pintle and having one end open in the outer surface of said pintle for selective communication with said cylinder bores and the opposite end open in the outer surface of said integrally formed block of said pintle for continuous communication with a port formed in said first annular member.

7. The device of claim 8, wherein each of said through bores in said pintle is formed at one end with a pressure pocket for providing a third static pressure bearing between said pintle and said cylinder barrel and at the opposite end with a pressure pocket for providing a fourth static prssure bearing between said pintle and said first annular member.

8. The apparatus os claim 7, wherein the position, area and angle of each of said second, third and fourth static pressure bearings are set to such values that the static pressures acting on said pistons, said cylinder barrel and said pintle are balanced.

* * * * *